United States Patent [19]

Giblin

[11] Patent Number: 5,002,222

[45] Date of Patent: Mar. 26, 1991

[54] CARTON WITH CLOSURE

[75] Inventor: Edward J. Giblin, Finksburg, Md.

[73] Assignee: Lever Brothers Company, New York, N.Y.

[21] Appl. No.: 459,084

[22] Filed: Dec. 29, 1989

[51] Int. Cl.[5] ..... B65D 5/54

[52] U.S. Cl. ..... 229/123.1; 206/631.2; 206/633; 229/125.09

[58] Field of Search ..... 229/123.1, 123.3, 125.09; 206/621.3, 621.7, 626, 631.2, 633, 629, 628

[56] References Cited

U.S. PATENT DOCUMENTS

| | | | |
|---|---|---|---|
| 1,915,503 | 6/1933 | Schmidt | 206/629 |
| 2,177,999 | 10/1939 | Schwantes | 206/628 |
| 2,218,670 | 10/1940 | Bennett | 206/621.7 |
| 2,340,651 | 2/1944 | Penison | 229/123.1 |
| 3,127,082 | 3/1964 | Meyer-Jagenberg | 229/123.3 |
| 4,632,299 | 12/1986 | Holmberg | 206/626 |
| 4,715,528 | 12/1987 | Kjelgaard et al. | 229/123.1 |

FOREIGN PATENT DOCUMENTS

| | | | |
|---|---|---|---|
| 4932 | 10/1979 | European Pat. Off. | 206/626 |
| 776131 | 1/1935 | France | 206/621.3 |
| 562718 | 4/1969 | France | 206/631.2 |
| 194525 | 2/1965 | Switzerland | 206/621.7 |

*Primary Examiner*—Gary E. Elkins
*Attorney, Agent, or Firm*—Gerard J. McGowan, Jr.

[57] ABSTRACT

The present invention is directed to a carton blank and a carton made therefrom which can be readily opened by consumers and yet which does not require extra thickening for balancing the carton or add appreciably to the amount of plastic present on the container. The invention comprises a carton blank including a die cut on one of the panels. The die cut intersects the upper score line of the panel at at least two points and creates an area of the panel which can be readily removed to form an opening. Preferably, the die cut extends beyond the score line onto the top minor flap adjacent the panel. Covering the die cut is a tape which adheres at least to the area within the die cut and by means of which the area of the die cut can be removed from the plane of the panel, thereby opening the carton. Preferably, the tape adheres removably to at least a portion of the area of the panel not within the die cut so that the tape keeps the die cut area within the plane of the panel when it is desired to have the carton closed, yet can be lifted by the consumer to remove the die cut area from the plane of the panel.

14 Claims, 1 Drawing Sheet

CARTON WITH CLOSURE

BACKGROUND OF THE INVENTION

Cartons for powdered detergents have typically included perforations in one of the side panels for opening the carton. Consumers have been expected to separate the perforated opening from the rest of the side panel to open the carton. Unfortunately, consumers have often found it difficult to separate the opening from the rest of the panel. Moreover, once open, the tendency was for the powdered product to spill from the carton when the carton was being transported from its place of storage to the washing location.

Gunn U.S. Pat. No. 4,732,315 discloses a plastic fitment which serves as a pouring spout and a cover for detergent cartons. However, the use of plastic materials on the paperboard carton is undesirable on environmental grounds since the plastic tends not to degrade after use. Moreover, Gunn indicates that the added thickness of his fitment requires means integral to the carton to thicken the carton and offset the additional thickness of the fitment when the cartons are stacked in a flattened tubular form prior to erection. Therefore, there is a need for a carton opening which can be readily utilized by the consumer, yet which requires little or no additional plastic material.

SUMMARY OF THE INVENTION

The present invention is directed to a carton blank and a carton made therefrom which can be readily opened by consumers and yet which does not require extra thickening means for balancing the carton or add appreciably to the amount of plastic present on the container. The invention comprises a carton blank including a die cut on one of the panels. The die cut intersects the upper score line of the panel at at least two points and creates an area of the panel which can be readily removed to form an opening. Preferably, the die cut extends beyond the score line onto the top minor flap adjacent the panel. Covering the die cut is a tape means which adheres at least to the area within the die cut and by means of which the area of the die cut can be removed from the plane of the panel, thereby opening the carton. Preferably, the tape means adheres removably to at least a portion of the area of the panel not within the die cut so that the tape means keeps the die cut area within the plane of the panel when it is desired to have the carton closed, yet can be lifted by the consumer to remove the die cut area from the plane of the panel.

According to one aspect of the invention, the tape means and die cut cover are relatively rigid so that when the combined layers are lifted from the plane of the panel, they maintain a relatively flat shape in the open position. The ability of the tape/cover means to remain in the open position is enhanced by the presence of a portion of the tape means on the minor flap, which when the carton is erected, will be perpendicular to the panel. As a result, when the tape means and cover portion are pulled open, they will tend to remain in the open position and not impede the egress of product from the carton. Preferably, the score line separating the minor flap from the panel includes a die cut perforation which enhances the ability of the score line to act as a hinge for the tape means. If desire, the tape means may include a lift tab which preferably does not adhere to the side panel.

DETAILED DESCRIPTION OF THE INVENTION

Figure 3:
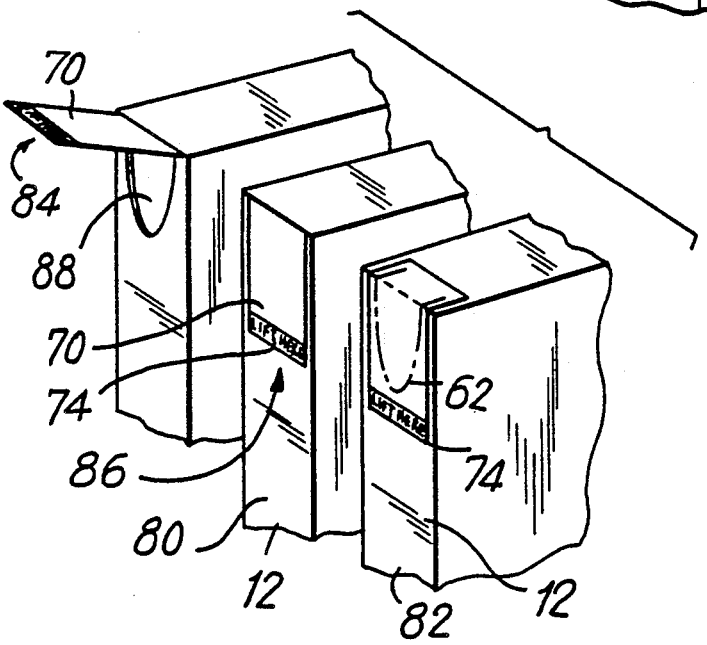

FIG. 3 comprises perspective views of an open carton and two closed cartons according to the invention.

Figure 1:
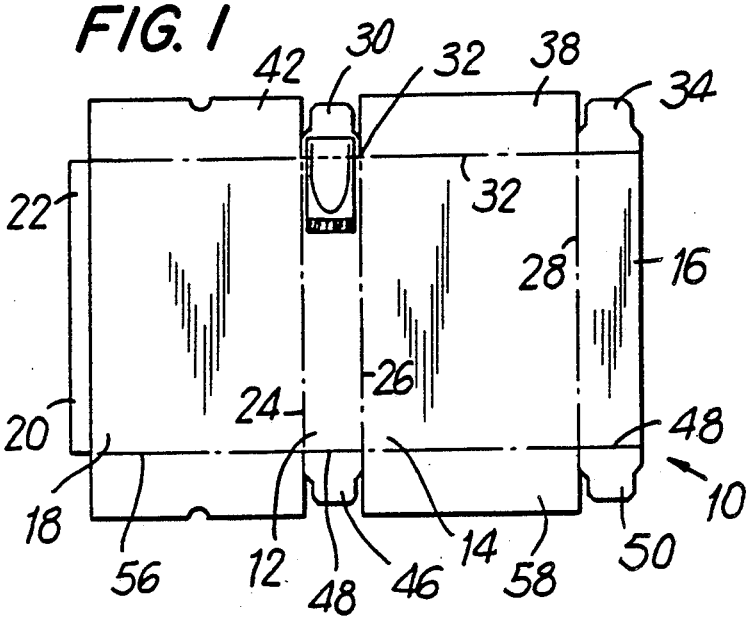
FIG. 1 is a top plan view of a carton blank according to the invention.

Referring to FIG. 1, a carton blank 10 comprises a first side panel 12, a front panel 14, a second side panel 16, and a rear panel 18. A glue flap 20 is separated from rear panel 18 by score line 22. Score line 24 separates rear panel 18 from side panel 12, whereas score line 26 separates first side panel 12 from front panel 14. Second side panel 16 is separated from front panel 14 by score line 28. Minor flap 30 is separated from first side panel 12 by score line 32. Likewise, minor flap 34 is separated from second side panel 16, upper outside major flap 38 is separated from front panel 14 and upper inside major flap 42 is separated from rear panel 18 by score line 32.

Lower minor flap 46 is separated from first side panel 12, lower minor flap 50 is separated from second side panel 16, lower inside major flap 54 is separated from rear panel 18, and lower major outside flap 58 is separated from front panel 14 all by score line 48.

Figure 2:
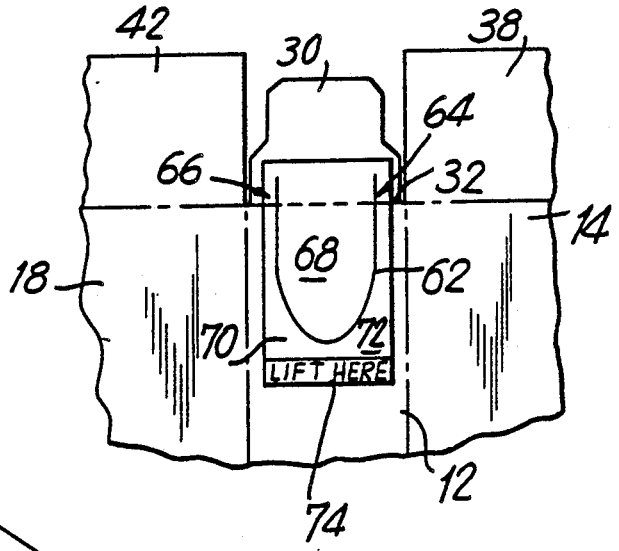
FIG. 2 is a top plan view of the side panel and minor flaps of the carton blank according to the invention.

Referring especially to FIG. 2, die cut 64 in a general U-shape has been impressed on side panel 12. The die cut intersects score line 32 at two points 64 and 66 and extends on to minor flap 30. Tape means 70 covers the area of the die cut and adheres thereto because the area is unvarnished. In general, non-sealing surfaces may be varnished whereas sealing surfaces will not be. Tape means 70 covers portions of both side panel 12 and minor flap 30. Because of the varnished surface on the carton's side panel, tape means 70 adheres releasably to portion 72 of side panel 12 outside of the die cut so that tape means 70 may be lifted from side panel 12 and will bring with it die cut encompassed area 68 to create an aperture. Tape means 70 preferably is comprised of a relatively clear and durable film material, such as a flexible polyolefin (e.g., polyethylene) with a pressure sensitive adhesive layer. However, the tape may be opaque, if desired. Even if the tape is not comprised of a relatively durable material, it will be supported in position 84 by side panel portion 68, which will be retained in that position due to the extension of the U-shaped die cut on to the minor flap, which is perpendicular to the side panel once the carton has been erected. Tape means 70 preferably includes a lift tab 74, which does not adhere to side panel 1.

The carton is erected in the typical manner. First, the carton is formed into a flattened tube by adhering the glue flap 20 to the rear of second side panel 16. Then, the carton is squared, the minor flaps are turned inwardly to be perpendicular to the side panels, the inside major flaps are folded inwardly and the outside major flaps are folded inwardly and adhered to the inside major flaps. Product may be inserted after the carton has been erected through one end of the carton after the other end of the carton has been closed by folding and adhering the closure flaps, e.g., the bottom minor and inside and outside major flaps.

FIG. 3, shows carton 80 having the tape means in the closed position with the U-shaped die cut in phantom.

In operation, the consumer would grasp the lift tab 74 of closed carton 80 and pull it toward him/her. The lift tab is preferably not adhered to carton panel 12, although the rest of tape means 70 is releasably adhered to the portion of panel 12 not encompassed by die cut 66. When lift tab 74 is pulled, portion 68 of side panel 1, which is adhered to the tape means, is lifted from the plane from side panel 1 upwardly until the tape means reaches position 84 indicated in FIG. 3. Since tape means 70 is adhered to at least a portion of minor flap 30, which is disposed perpendicular to side panel 1, tape means 70 is retained in position 84. With tape means in that position, the consumer may pour product from the carton by grasping the carton along second side panel 16 and rear and front panels 18 and 14 respectfully to tilt the carton and dispense the product without interference from tape means 70. When the consumer has finished dispensing the desired amount of product, tape means 70 may be pulled downwardly and returned to position 86 covering the carton opening 88. Since the tape means is comprises of a material which will adhere to the side panel 1, the carton is closed and will not open until the consumer again grasps the lift tab. When the tape is adhered to carton panel 12, portion 68 acts as a plug within carton opening 88.

What is claimed is:

1. A carton blank comprising a top flap, a score line defining the bottom of said top flap, and a panel below said top flap, said panel including a die cut intersecting said score line at at least two points, tape means adhering to the area of said panel within said die cut and covering said die cut and a portion of said top flap.

2. The carton blank according to claim 1 wherein said die cut extends past each point of intersection with the score line onto the top flap.

3. The carton blank according to claim 1 wherein said tape means adheres releasably to portions of said side panel outside of the area of said die cut.

4. The carton blank of claim 2 wherein the die cut is U-shaped.

5. The carton blank of claim 2 wherein said tape means is clear.

6. The carton blank of claim 1 wherein said panel is a side panel, said top flap is a minor flap and further comprising a front panel adjacent said side panel, a rear panel adjacent said side panel on the opposite side from said front panel, a second side panel adjacent said front panel, major closure flaps on top of said front and rear panels and a second minor flap on top of said second side panel.

7. The carton blank according to claim 1 wherein said score line separating said top flap and said panel includes die cut perforations.

8. A carton comprising a top flap, a score line defining one end of said top flap, and a panel adjacent said top flap separated from said top flap by said score line, said panel including a die cut intersecting said score line at at least two points, tape means adhering to the area of said panel within said die cut and covering said die cut and a portion of said top flap, the portion of said panel within said die cut being removable from the plane of said panel to create an opening by lifting the tape means.

9. The carton according to claim 8 wherein said die cut extends past each point of intersection with the score line onto the top flap.

10. The carton blank according to claim 8 wherein said tape means adheres releasably to portions of said side panel outside of the area of said die cut.

11. The carton of claim 8 wherein the die cut is U-shaped.

12. The carton of claim 2 wherein said tape means is clear and durable and pressure sensitive.

13. The carton of claim 8 wherein said panel is a side panel, said top flap is a minor flap and further comprising a front panel adjacent said side panel, a rear panel adjacent said side panel on the opposite side from said front panel, a second side panel adjacent said front panel, major closure flaps on top of said front and rear panels and a second minor flap on top of said second side panel.

14. The carton of claim 5 wherein said tape means has pressure sensitive properties.

* * * * *